US005151552A

United States Patent [19]

Alessandri, Jr.

[11] Patent Number: 5,151,552

[45] Date of Patent: Sep. 29, 1992

[54] TUBULAR CHOKE WRENCH APPARATUS

[76] Inventor: Louis A. Alessandri, Jr., 24 French St., Rehoboth, Mass. 02769

[21] Appl. No.: 818,861

[22] Filed: Jan. 10, 1992

[51] Int. Cl.[5] ..... F41A 35/00; F41C 27/00

[52] U.S. Cl. ..... 42/90; 81/176.15

[58] Field of Search ..... 42/79, 90, 49.01, 49.02; 29/1.1; 81/176.1, 176.15, 451, 3.05

[56] References Cited

U.S. PATENT DOCUMENTS 4,736,540 4/1988 Holmes ..... 42/90
4,837,962 6/1989 Longerot ..... 42/90
4,843,747 7/1989 Echeberria ..... 42/90
4,878,306 11/1989 Dyer ..... 42/90
4,951,409 8/1990 Froid ..... 42/90
4,959,917 10/1990 Mavrakis et al. ..... 81/3.05

*Primary Examiner*—D. S. Meislin
*Attorney, Agent, or Firm*—John A. Haug

[57] ABSTRACT

A choke wrench for installing and removing tubular chokes respectively in and from gun barrels is shown having an eccentric handle attached to a base plate and a cylindrical guide attached to the opposite side of the base plate. The guide is removable and captures a removable blade which is automatically centered relative to the guide and which is receivable in a choke to be inserted into or taken out of the bore of a gun. A storage chamber is formed in the guide to accommodate alternate blades for use with the wrench.

12 Claims, 2 Drawing Sheets

TUBULAR CHOKE WRENCH APPARATUS

This invention relates generally to gun accessories and more specifically to a mechanism for installing and removing tubular chokes in and from gun barrels.

The use of tubular chokes in shot guns to govern the pattern of shot is well known. Typically such chokes are designed to be screwed into and are flush with the end of the muzzle. Such chokes are of many variations for both lead and steel shot including full, modified, improved, skeet, open and so on. The choke tubes generally have a threaded portion about their periphery over a portion of their axial length and are provided with pairs of slots at their outer end for reception of a blade so that the tube can be rotated into and out of a threaded portion in the muzzle of a barrel. It is common to use a specialized tool having an elongated cylindrical guide portion receivable in the barrel with resilient means such as an O-ring on the guide portion to prevent scratching and marring of the internal surface of the bore. The guide portion also aids in properly orienting the threads so that cross threading is minimized. The guide portion is fixedly mounted on a base plate with a blade projecting downwardly from the base plate along the longitudinal axis of the guide portion and extending radially outward beyond the guide portion for reception into a pair of slots of a choke tube as the guide portion is passed through the tube. An eccentric handle is provided on the opposite side of the base plate to facilitate rotation of the tool.

While this tool is effective it is limited to the specific dimensions of a given choke requiring different tools for different style chokes. That is, one manufacturer uses slots having a certain width while another manufacturer may use slots having a different width so that one tool would not be useful with both chokes. This presents a problem both with regards to expense in having to duplicate tools but also in space since it is highly desirable to minimize the amount of equipment which a shooter must carry.

It has been proposed to provide a tool which can be used with any type of screw-in choke by having an expandable shaft portion adapted to tightly engage the internal bore of the choke in order to install and remove the choke however this suffers from the limitation that it does not have a positive locking capability.

It is an object of the present invention to overcome the above noted difficiencies of the prior art. It is another object to provide a tool for installing and removing chokes which is simple, reliable, safe and adapted to a wide variety of choke styles and sizes.

Briefly, in accordance with the invention, a generally cylindrical hub and integrally attached threaded shank depends from a base plate. The distal end of the threaded shank is bifurcated and a blade member is removably received between the bifurcations and is captured there by an elongated, generally cylindrical, guide member having a threaded aperture in an end thereof into which the shank is received. Flexible O-rings are disposed in annular grooves in the guide member to protect the internal surface of the gun barrel and to prevent cross-threading. According to a feature of the invention the blade member is provided with parallel extending arms which center the guide member relative to the hub. According to another feature of the invention the guide member is formed with a storage chamber adapted to accommodate alternate blade members. The guide member is also provided with a knurled portion and a slot in an end thereof to facilitate assembly and disassembly of the tool.

Various other objects and advantages will appear from the following description of an embodiment of the invention and the novel features will be particularly pointed out hereinafter in connection with the accompanying drawings and the appended claims.

Figure 3:
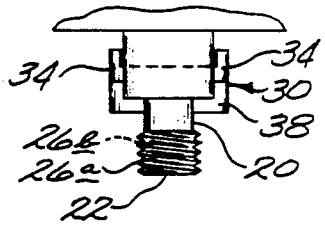
FIG. 3 is a broken away front elevational view of the blade seating portion of the wrench with a blade received in the seat.

In the illustrated embodiment of the invention being described, choke wrench 10 comprises an elongated base plate 12 of any suitable material, such as aluminum, mounting a centrally located, generally cylindrical, hub 14 preferably of the same material as the base plate, which depends from a lower face of base plate 12. Hub 14 is fixedly attached to base plate 12 in any conventional manner as by inserting an end into a bore 16 in the base plate and locking the two members together by a retainer 18 placed in a bore extending from front to back through the base plate and hub 14. A slot is formed in hub 14 and a shank 20 is integrally attached to and extends along the longitudinal axis of the hub. The slot extends from the distal end 22 of shank 20 to a blade seat surface 24 forming bifurcations or legs **26*a*, 26*b*; leg 26*b* being shown in FIG. 1 and leg 26*a* being shown in FIG. 3. The outer distal portion of shank 20** is threaded for a purpose to be described below.

Figure 4:
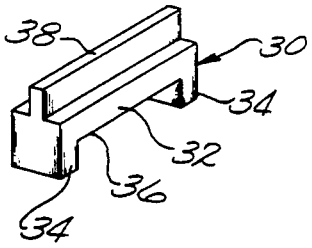
FIG. 4 is an enlarged perspective view of a choke receiving blade useful with the invention.

A choke receiving blade member 30 formed of suitable material such as case hardened cold rolled steel has a base 32 with arms 34 depending in a first direction, downwardly as seen in FIG. 4, from opposite ends of base 32 with a flat seating surface 36 formed therebetween. Blade 38, generally configured as a parallelepiped, extends in a second, opposite direction from base 32, upwardly as seen in FIG. 4.

Blade member 30 is removably mounted on hub 14 by placing the member between legs **26*a* and 26*b* with seating surface 36 received on seat 24 of the hub and arms 34 staddling the hub. Arms 34 are space apart a distance essentially the same as the diameter of hub 14 so that the blade is automatically centered when received on seat 24**.

Figure 5:
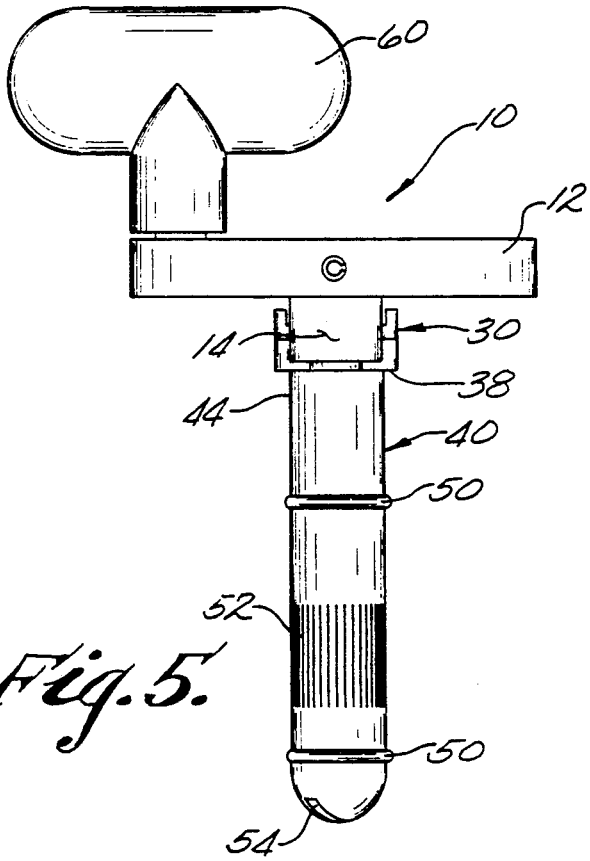
FIG. 5 is a front elevational view of the FIG. 1 choke wrench in the assembled condition.

An enlarged, generally cylindrical, guide member 40 of suitable material, preferably the same as hub 14, is formed with a threaded aperture 48 at one end 44 and a second closed end 46. Threaded aperture 48 is adapted to receive the threaded shank 20 thereby capturing blade member 30 in its seat by engaging the central portion of blade 38 as seen in FIG. 5 with the distal portion of end 44. Guide member 40 is also formed with a cavity 42 for a purpose to be discussed below.

Figure 1:
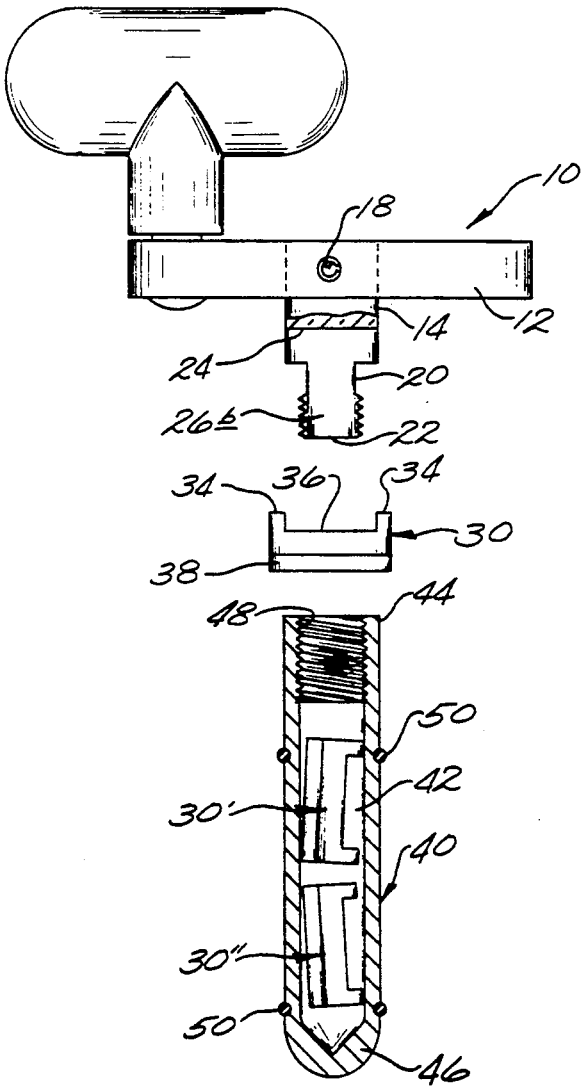
FIG. 1 is a blown-apart front elevational view, partly in cross section, of a choke wrench made in accordance with the invention.
Figure 2:
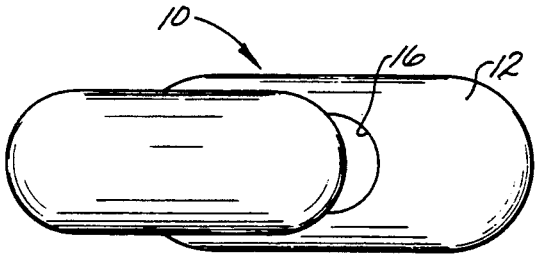
FIG. 2 is a top plan view of the FIG. 1 choke wrench.

Guide member 40 is preferably formed with first and second spaced annular grooves adapted to receive O-rings 50 extending radially beyond the periphery of the guide member to center the guide member within a gun bore in order to avoid scratching of the bore surface as well as to prevent cross threading during intallation of a choke. As seen in FIG. 1, cavity 42 extends essentially the whole length of the guide member in order to provide a storage chamber for alternate blade members 30', 30'' having different blade dimensions for use with chokes having different slot dimensions.

Guide member 40 may be provided with a knurled 52 portion around its periphery, preferably intermediate the O-rings, as well as a slot 54 in closed end 46, if desired, to facilitate assembly and disassebly of the wrench.

A handle 60 is mounted on base plate 12 in a conventional manner, preferably at one end of the base plate, to facilitate imparting rotational movement to the choke wrench. Preferably handle 60 is pivotably mounted so that the user can more easily rotate the wrench.

Figure 6:
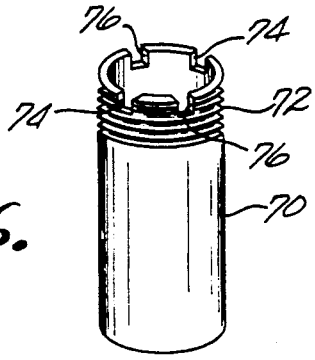
FIG. 6 is a perspective view of a typical choke with which the invention can be used.

As seen in FIG. 6 a typical tubular choke 70 is shown having a threaded portion 72 and pairs of slots 74, 76. Guide member 40 is inserted into the choke and moved through the choke until the outer portions of blade 38 are received in a pair of slots. The choke wrench is then rotated to insert or remove the choke in a given barrel, not shown.

The choke wrench of the present invention is readily adapted to any of a variety of sizes and styles of tubular chokes merely by replacing the blade member with another conveniently stored in the storage chamber of the guide member.

It will be understood that various changes in the details, materials, and arrangements of parts, which have been described and illustrated in order to explain the nature of the invention, may be made by those skilled in the art within the principle and scope of the invention, as expressed in the appended claims.

I claim:

1. Choke wrench apparatus for installing and removing tubular chokes in and from gun bores comprising:

a base plate, a generally cylindrical hub means mounted on the base plate, the hub means having a distal end bifurcated forming first and second legs extending from a blade member seat and having a male threaded portion, a generaly U-shaped blade member having a central body portion and first and second arms extending in a first direction from the body portion spaced apart a distance generally equal to the diameter of the cylindrical hub, the body portion between the first and second arms having a seating surface, a blade having a generally parallelepiped configuration extending from the body portion in a second direction opposite the first direction, the blade member removably received between the first and second legs of the hub means with the seating surface of the body portion engaging the blade member seat and the first and second spaced arms of the blade member extending along an outer surface of the hub, an elongated guide member formed with a threaded aperture in a distal end thereof, the guide member adapted to be screwed onto the hub means with the distal end of the guide means capturing the blade member and locking the blade member in its seat, the blade extending radially beyond the hub means and the guide member and adapted to fit within slots of a choke.

2. Choke wrench apparatus according to claim 1 in which a cavity is formed within the guide member in communication with the threaded aperture and is adapted to receive alternate blade members.

3. Choke wrench apparatus according to claim 2 in which the cavity extends essentially along the entire of the length of the guide member.

4. Choke wrench apparatus according to claim 2 in which the elongated guide member is generally cylindrical with a pair of annular grooves formed about the periphery of the guide member and an O-ring is received in each groove and extends out of the groove beyond the periphery of the guide member.

5. Choke wrench apparatus according to claim 4 in which a knurled section is formed on the outer surface of the guide member along a portion of its length between the annular grooves.

6. Choke wrench apparatus according to claim 1 in which a slot is formed in the closed end of the guide member.

7. Choke wrench apparatus according to claim 1 further including a handle mounted on the base plate on a side opposite to the hub means and spaced from the longitudinal axis of the hub means.

8. Choke wrench apparatus according to claim 7 in which the handle is rotatably mounted on the base plate.

9. Choke wrench apparatus for installing and removing tubular chokes in and from respectively gun bores comprising:

a generally cylindrical hub, an integrally formed threaded shank extending along the longitudinal axis of the hub, a slot formed in the shank parallel to and passing through the longitudinal axis, the slot defining first and second legs spaced apart by a blade member seat, a blade member comprising a central body portion forming a seating surface, a generally parallelepiped blade extending from the central body portion, the blade member received in the slot with the seating surface received on the seat, a generally cylindrical guide member having a threaded aperture in a distal end face adapted to receive the threaded shank, the distal end face of the guide member adapted to engage the blade and lock the blade member in its seat, the blade extending radially beyond the hub and guide member and adapted to fit within the slots of a tubular choke.

10. Choke wrench apparatus according to claim 9 in which a storage chamber is formed in the guide member in communication with the aperture and is adapted to receive alternate blade members.

11. Choke wrench apparatus according to claim 9 in which the blade member is formed with first and second, parallel extending arms, the arms spaced apart a distance essentially equal to the diameter of the hub, the arms lying along the outer surface of the hub when the blade member is received in its seat whereby the blade is automatically centered relative to the hub.

12. Choke wrench apparatus according to claim 10 further including eccentric handle means attached to the hub.

* * * * *